United States Patent [19]

Schwär

[11] Patent Number: 4,972,631

[45] Date of Patent: Nov. 27, 1990

[54] OSCILLATORY DRIVE FOR FINE-GRINDING MACHINE

[75] Inventor: Rudolf Schwär, Wuppertal, Fed. Rep. of Germany

[73] Assignee: Maschinenfabrik Ernst Thielenhaus GmbH, Wuppertal, Fed. Rep. of Germany

[21] Appl. No.: 445,887

[22] Filed: Dec. 4, 1989

[30] Foreign Application Priority Data

Dec. 2, 1988 [DE] Fed. Rep. of Germany ..... 3840595

[51] Int. Cl.[5] ..... B24B 7/00

[52] U.S. Cl. ..... 51/59 R; 51/56 R; 51/34 R

[58] Field of Search ..... 51/33 R, 34 R, 55, 56 R, 51/58, 59 R, 168; 384/536, 582

[56] References Cited

U.S. PATENT DOCUMENTS 3,345,783 10/1967 Militzer ..... 51/59 R X
3,447,846 6/1969 Marsh ..... 384/536
3,743,365 7/1973 Kato ..... 384/536
4,150,511 4/1979 Khokhulin et al. ..... 51/59 R X
4,664,659 5/1987 Schwär et al. .
4,800,683 1/1989 Schwär .

*Primary Examiner*—James G. Smith
*Attorney, Agent, or Firm*—Herbert Dubno; Andrew M. Wilford

[57] ABSTRACT

A fine-grinding machine having a tool engageable with a workpiece is oscillated linearly at high speed has a drive comprising a tool-carrying slide having a connecting pin extending along an output axis, an input shaft centered on and normally rotating about an input axis offset from and generally parallel to the output axis, an eccentric carried on the shaft and having an outer surface eccentric to the input axis, and a link having an input end at the input axis and an output end at the output axis. A roller bearing supports the input link end on the outer surface of the eccentric. An elastomeric sleeve bearing snugly surrounds the connecting pin and snugly fits in the output end of the link.

5 Claims, 2 Drawing Sheets

2
TOOL
15
6
4
3A
1
M
3
14
2
18
5
12
17
7A
10
9
8
13
7
11
2

OSCILLATORY DRIVE FOR FINE-GRINDING MACHINE

FIELD OF THE INVENTION

The present invention relates to a fine-grinding machine. More particularly this invention concerns an oscillatory drive for such a machine.

BACKGROUND OF THE INVENTION

A standard grinding machine, for example a fine-grinding machine for honing or finish grinding a camshaft or crankshaft, has a tool holder carrying the grinding tool and itself mounted on a reciprocal or linearly oscillating tool slide. The required high-speed linear oscillation is imparted to this slide from an input shaft which is rotated continuously about an input axis and which carries an eccentric. The slide is provided with a connecting pin extending along and centered on an output axis parallel to and offset from the input axis, and a link is coupled between the eccentric and the connecting pin. A roller bearing supports the input end of the link on the surface of the eccentric.

As a rule the output end of the link is supported on the connecting pin by another roller bearing, normally a small-gap needle bearing. The function of this output bearing is to eliminate the angular oscillation of the output end of the link so that only the linear oscillation in the plane defined by the two axis is imparted to the tool slide. Thus this output bearing is subjected to high-speed reversals, often in the neighborhood of 1500 per minute. As a result its service life is extremely limited and, in fact, this output bearing needs replacement at a rate that itself determines the mean time between failures of the grinding machine.

OBJECTS OF THE INVENTION

It is therefore an object of the present invention to provide an improved drive for a grinding machine.

Another object is the provision of such an improved drive for a grinding machine which overcomes the above-given disadvantages that is whose service life is relatively long.

SUMMARY OF THE INVENTION

A fine-grinding machine wherein a tool engageable with a workpiece is oscillated linearly at high speed has a drive comprising a tool-carrying slide having a connecting pin extending along an output axis, an input shaft centered on and normally rotating about an input axis offset from and generally parallel to the output axis, an eccentric carried on the shaft and having an outer surface eccentric to the input axis, and a link having an input end at the input axis and an output end at the output axis. A roller bearing supports the input link end on the outer surface of the eccentric. According to this invention an elastomeric sleeve bearing snugly surrounds the connecting pin and snugly fits in the output end of the link.

This sleeve bearing is sufficiently deformable that it can take up the limited angular oscillation of the link without damage to itself. It is therefore possible not only for the mean time between failures of this bearing to be at least twice that of the standard roller-type needle bearing, but it is also possible to increase the oscillation rate, which is equal to the revolutions per minute of the input shaft, from 1500 oscillations/minute to 2500 oscillations/minute.

According to this invention the elastomeric sleeve bearing includes an outer metal sleeve fixed in the output end of the link, an inner metal sleeve fixed on the connecting pin, and an elastomeric sleeve between and fixed to the metal sleeves. All the sleeves are coaxial on the output axis and releasable clamps are provided for the inner and outer metal sleeves so the bearing is removable.

The service life of the grinder can be further increased by providing means for cooling the sleeve bearing, for instance a blower or liquid cooler.

DESCRIPTION OF THE DRAWING

The above and other objects, features, and advantages will become more readily apparent from the following, reference being made to the accompanying drawing in which.

SPECIFIC DESCRIPTION

Figure 1:
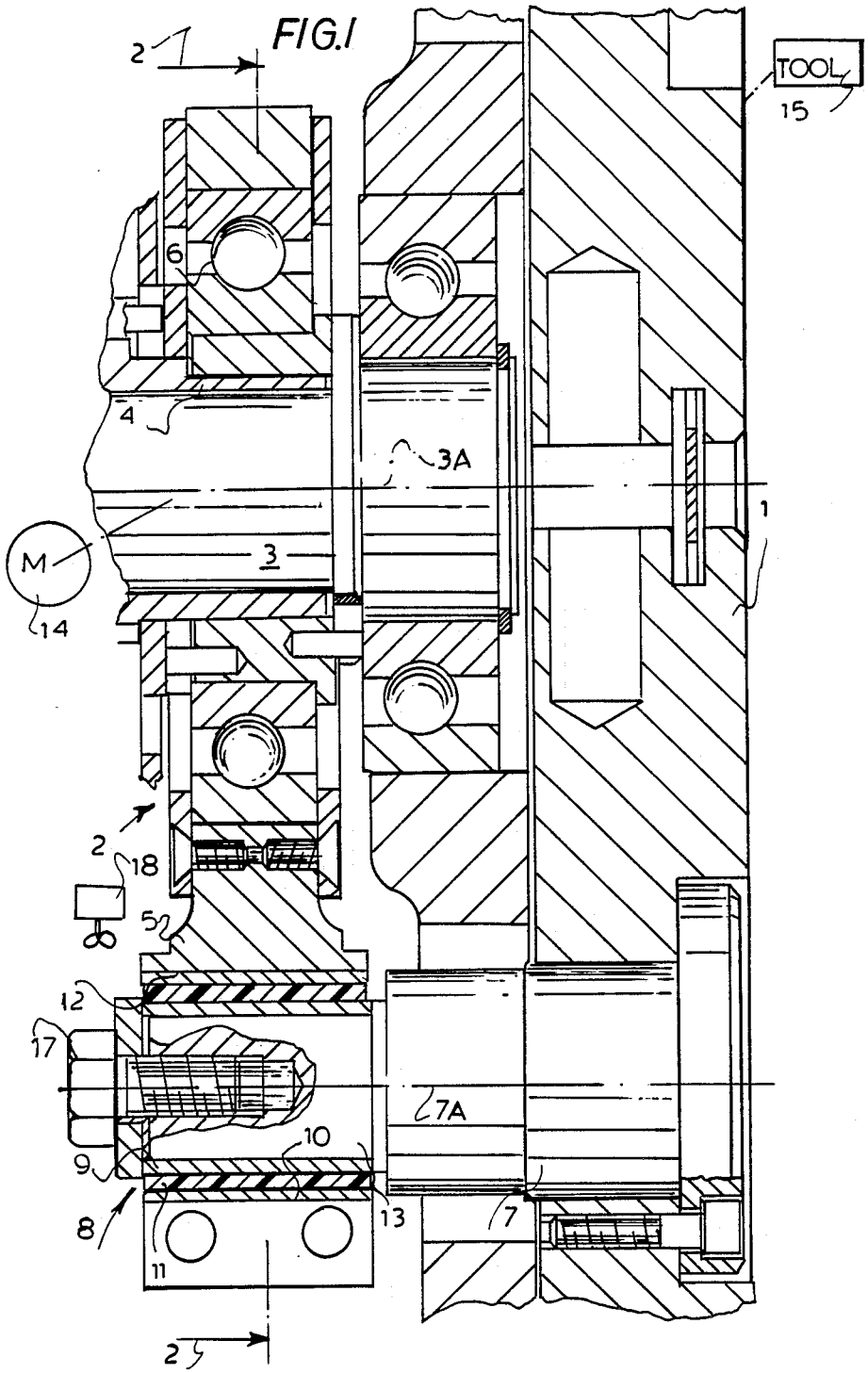
FIG. 1 is a partly diagrammatic axial section through the apparatus according to this invention.
Figure 2:
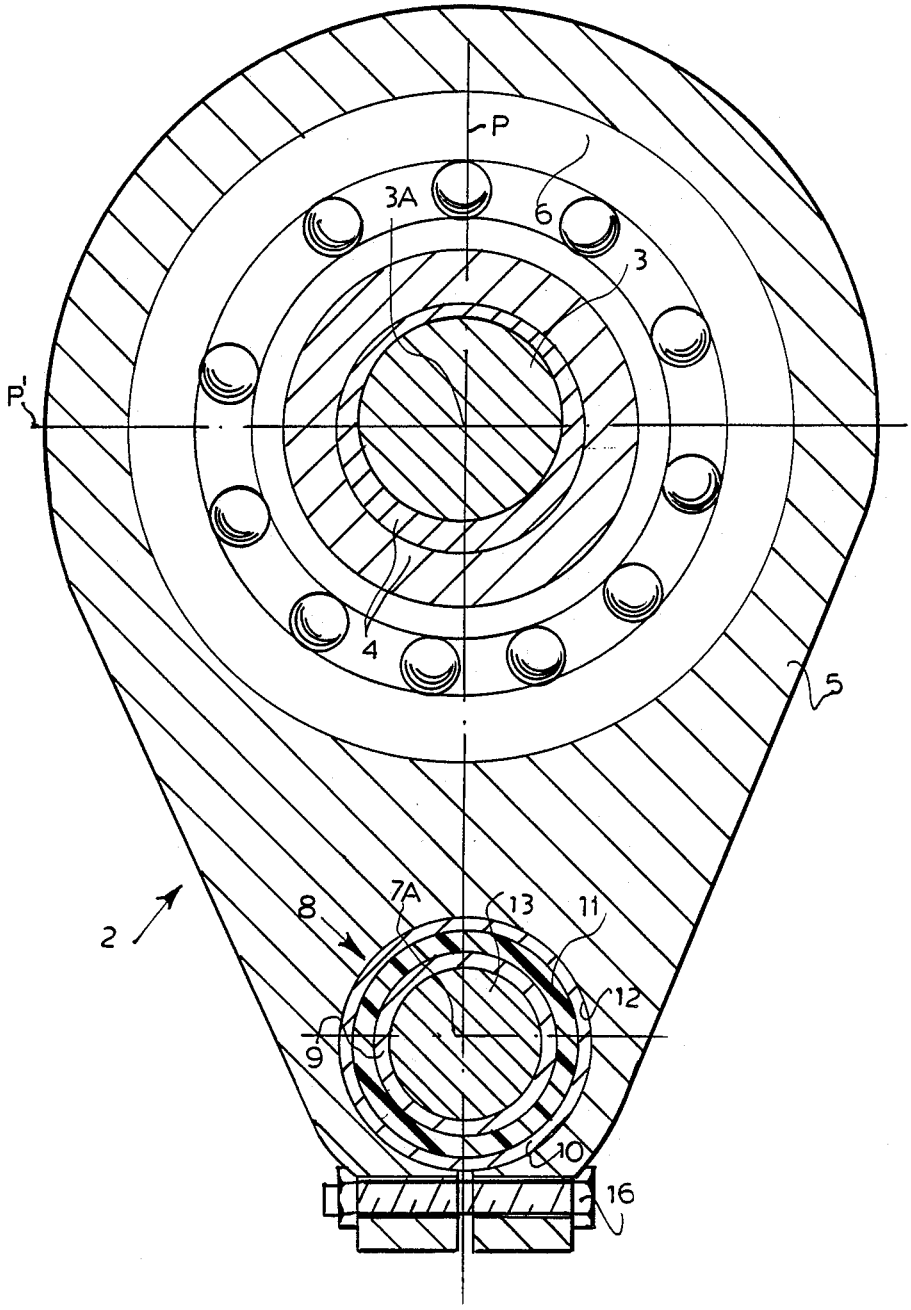
FIG. 2 is a cross section taken along line 2—2 of FIG. 1.

As seen in FIGS. 1 and 2 a tool slide 1 carrying via an unillustrated tool holder a tool shown schematically at 15 is supported for movement linearly parallel to the planes of the views of FIGS. 1 and 2. This linear oscillation or reciprocation is effected by a drive 2 having an input shaft 3 centered on an axis 3A and continuously rotated about this axis 3A by a motor indicated schematically at 14.

This shaft 3 has a cylindrical outer surface centered on the axis 3A and carries in turn a two-part eccentric sleeve 4 whose outer surface is cylindrical but centered on an axis parallel to but offset from the axis 3A. A coupling element or link 5 has an input end formed with a large-diameter hole in which is received a roller bearing 6 that fits on the outer eccentric surface. The link 5 has an opposite output end formed with a hole 12 into which is fitted an elastomeric bearing 8 in turn fitted around a cylindrical extension 13 of a connecting pin 7 fixed on the slide 1 and centered on an axis 7A parallel to the axis 3A. This bearing 8 comprises an inner steel sleeve 9 clamped by a bolt 17 to the extension 13, an outer steel sleeve 10 secured by clamping screws 16 in the output end of the link 5, and a rubber sleeve 11 bonded between these sleeves 9 and 10.

Thus as the shaft 3 rotates about the axis 3A the input end of the link 5 will be reciprocated radially in a plane P formed by the two axes 3A and 7A and also radially in a plane P′ perpendicular thereto. The movement in the plane P will be transmitted via the bearing 8 to the pin 7 and thence to the tool 15. The movement in the plane P′ will be converted to angular oscillation of the output end of the link 5 about the axis 7*a*, a motion that the pin 7 cannot follow. Thus this angular oscillation will be taken up by deformation of the elastomeric sleeve 11.

Since the elastic limit of the sleeve part 11 is not exceeded by the above-described deformation this element will have a very long service life. Provision of cooling means such as the blower indicated schematically at 18 can prolong its service life even further.

I claim:

1. In a fine-grinding machine wherein a tool engageable with a workpiece is oscillated linearly at high speed, a drive comprising:

a tool-carrying slide having a connecting pin extending along an output axis;

an input shaft centered on and normally rotating about an input axis offset from and generally parallel to the output axis;

an eccentric carried on the shaft and having an outer surface eccentric to the input axis;

a link having an input end at the input axis and an output end at the output axis:

a bearing supporting the input link end on the outer surface of the eccentric; and an elastomeric sleeve bearing snugly surrounding the connecting pin and snugly fitting in the output end of the link.

2. The grinding-machine drive defined in claim 1 wherein the elastomeric sleeve bearing includes an outer metal sleeve fixed in the output end of the link, an inner metal sleeve fixed on the connecting pin, and an elastomeric sleeve between and fixed to the metal sleeves, all the sleeves being coaxial on the output axis.

3. The grinding-machine drive defined in claim 2 wherein the sleeve bearing is removable.

4. The grinding-machine drive defined in claim 1, further comprising means for cooling the sleeve bearing.

5. A fine-grinding machine comprising:

a tool slide displaceable only radially relative to an output axis and having a connecting pin extending along and centered on the output axis;

a tool carried on the slide and engageable with a workpiece;

an input shaft centered on and normally rotating about an input axis offset from and generally parallel to the output axis;

an eccentric carried on the shaft and having an outer surface eccentric to the input axis;

a link having an input end at the input axis and an output end at the output axis;

a bearing supporting the input link end on the outer surface of the eccentric; and an elastomeric sleeve including an outer metal sleeve fixed in the output end of the link, an inner metal sleeve fixed on the connecting pin, and an elastomeric sleeve between and fixed to the metal sleeves, all the sleeves being coaxial on the output axis.

* * * * *